US005160275A

United States Patent [19]

Nakamura et al.

[11] Patent Number: 5,160,275

[45] Date of Patent: Nov. 3, 1992

[54] ELECTRICAL CONNECTOR FOR CIRCUIT BOARDS

[75] Inventors: Masaru Nakamura; Kouzou Uekido; Tsunekazu Ukai, all of Tokyo, Japan

[73] Assignee: Hirose Electric Co., Ltd., Tokyo, Japan

[21] Appl. No.: 734,625

[22] Filed: Jul. 23, 1991

[30] Foreign Application Priority Data

Sep. 6, 1990 [JP] Japan ..... 2-93176
Oct. 16, 1990 [JP] Japan ..... 2-107668

[51] Int. Cl.[5] ..... H01R 13/62

[52] U.S. Cl. ..... 439/328; 439/593; 439/629

[58] Field of Search ..... 439/325-328, 439/629-632, 635-637, 592, 593

[56] References Cited

U.S. PATENT DOCUMENTS 3,710,303 1/1973 Gallager, Jr. ..... 439/593
4,586,772 5/1986 Cobaugh et al. ..... 439/629

FOREIGN PATENT DOCUMENTS 9004272 4/1990 European Pat. Off. ..... 439/328
2113018 7/1983 United Kingdom .

*Primary Examiner*—Larry I. Schwartz
*Assistant Examiner*—Hien D. Vu
*Attorney, Agent, or Firm*—Rosen, Dainow & Jacobs

[57] ABSTRACT

An electrical connector is provided which, when attached to a printed circuit board, will not cause removal of a cream solder that has been applied to the circuit board, and which will not flaw the surface of circuit portions. The connector has a resilient arm which undergoes elastic deformation to flex contacts perpendicularly away from the surface of the circuit portions when the circuit board is inserted into the connector. The resilient arm is restored to its original shape when the connector has been correctly fitted on the circuit board, thereby allowing the contacts to contact predetermined circuits. In another embodiment, the resilient arm is replaced by a frame member which is urged into the connector body by the circuit board. This causes the contacts to part perpendicularly from the surface of the circuit portions.

7 Claims, 6 Drawing Sheets

ELECTRICAL CONNECTOR FOR CIRCUIT BOARDS

BACKGROUND OF THE INVENTION

1. Field of the Invention

This invention relates to an electrical connector for circuit boards.

2. Description of the Related Art electrical connectors for connecting the circuit on a circuit board with an external circuit are available in the art. One type of electrical connector for this purpose is fitted onto an edge portion of the circuit board to make contact with a connecting portion of the circuit.

An example of such an electrical connector is illustrated in FIG. 5. The connector includes an insulating housing 51 from which two parallel rows of contacts 52 extend in cantilevered fashion. A circuit-board receiving groove 54 is formed in a projecting portion 53 located at both ends of the housing 51, and a portion of the circuit board receiving groove 54 has a key portion 55. The two rows of parallel contacts 52, one located above the other, include intermediate portions bent in such a manner that the opposing contacts in the two rows approach each other leaving a space between them which is smaller than the thickness of a circuit board P.

The circuit board P has a row of connecting circuit portions P1 formed along one edge portion thereof. This edge portion is provided with guide grooves P3, one on each side of the row of connecting circuit portions Pl, which are guided by respective ones of the keys 55.

When the connector is to be connected, a cream solder is sufficiently applied over an area S of the circuit portions P1 of circuit board P, after which the circuit board P is inserted between the upper and lower rows of the contacts 52 in such a manner that the guide grooves P2 mate with the keys 55 of the connector. As a result, the upper and lower contacts 52 make contact with the corresponding circuit portions P1. This is followed by heating the circuit portions P1 so that each contact is soldered and connected to the circuit on the circuit board P.

The following problems arise in the electrical connector for circuit boards in the example of the prior art described above:

(1) From the moment the contacts 52 start to contact the edge portion of the circuit board until the moment the connector has been fitted on the circuit board at the correct position, the contacts are in a sliding state relative to the circuit portions P1. As a consequence of such sliding, the cream solder is removed from the vital portions at which the contacts 52 make contact with the circuit portions P1.

(2) If the contacts 52 abut against the circuit portions P1 with a high pressure while sliding against the circuit portions P1 as described above, the surface of the contact portions P1 is scraped off.

(3) In the process for fitting the connector onto the circuit board P, the pressure which one applies upon the other is constant and therefore it is not possible to tell when the connector has arrived at the correct fitting position. In addition, since there is an inclination between the two in the direction of connector width, there is no assurance that the fitting of the connector on the circuit board will be accomplished reliably.

(4) The connector and the circuit board rely upon the keys 55 and guide grooves P3 for a proper fit. In order to achieve reliable positioning, the keys 55 and guide grooves P3 must be machined to a high precision.

SUMMARY OF THE INVENTION

An object of the present invention is to provide a simply constructed electrical connector for a circuit board in which the cream solder can be retained on the circuit board reliably, and in which the surface of the circuit portions will not be damaged when the connector is fitted on the circuit board.

In accordance with the present invention according to a first embodiment thereof, the foregoing object is attained by providing an electrical connector for being fitted on an edge portion of a circuit board and having contacts for coming into resilient pressured contact with circuit portions of the circuit board, the contacts and the circuit portions being soldered and connected together in a contacting state. The contacts extend from an insulating housing in cantilevered fashion and have distal ends supported by a resilient arm. The resilient arm has a projection which comes into abutting contact with the edge portion of the circuit board when the connector is fitted on the printed circuit board, and the resilient arm is elastically deformed by the abutting contact between the projection and the edge portion of the circuit board in such a manner that the contacts are spaced away from the surface of the circuit board. The projection mates with a locking recess of the circuit board, so that the resilient arm loses the elastically deformed state, when fitting of the connector on the circuit board at a correction position has been completed, whereby the contacts come into resilient pressured contact with the circuit portions.

In use of the connector according to the first embodiment constructed as set forth above, the connector is fitted on the circuit board with the edge portion of the circuit board being brought into abutting contact with the projection.

When the projection abuts against the edge portion of the circuit board, the resilient arm is elastically deformed so that the contacts, whose distal ends are being supported by the resilient arm, also are elastically deformed so as to be spaced away from the surface of the circuit board.

The connector is thus fitted on the circuit board at the correct position in a state where the contacts are not in contact with the circuit board. When this correct position is attained, the projection on the resilient arm snaps into engagement with the locking recess of the circuit board, as a result of which the arm is restored to its original shape. This allows the contacts to perpendicularly contact the surface of the circuit portions for the first time.

Finally, the contacts and circuit portions are heated to solder and connect the two together by means of a cream solder applied to the circuit portions in advance.

In accordance with the present invention according to a second embodiment thereof, the foregoing object is attained by providing an electrical connector for being fitted on an edge portion of a circuit board and having contacts for coming into resilient pressured contact with circuit portions provided on the edge portion of the circuit board, the contacts and the circuit portions being soldered and connected together in a contacting state. The contacts are implanted in an insulating housing in a cantilevered state and each has an intermediate portion formed to include a horizontal portion extending in a direction in which the connector is fitted on the circuit board. The insulating housing guides and retains an insulating frame member movable relative to the insulating housing in the direction in which the connector is fitted on the circuit board. The frame member has locking portions which, when the frame member is fitted into the insulating housing, engage the horizontal portions of the contacts and elastically deform the contacts in a direction which spaces the contacts away from the surface of the circuit portions of the circuit board; an insertion portion into which the edge portion of the circuit board is urged; and projections which, when the edge portion of the circuit board in urged into the insertion portion, mate with locking recesses formed in the edge portion of the circuit board. After the circuit board is engaged with the frame member by urging the circuit board into the frame member, the frame member is moved together with the circuit board into the insulating housing up to a position at which the connector is correctly fitted on the circuit board, as a result of which the locking portions of the frame member part from the horizontal portions of the contacts, whereby the contacts come into resilient pressured contact with the circuit portions of the circuit board.

According to the second embodiment of the invention constructed as set forth above, the circuit board and the connector are connected through the following procedure.

First, the frame member is fitted into the insulating housing. As a result, the horizontal portions of the contacts engage the locking portions of the frame member, whereby the contacts are caused to part from the surface of the circuit board when the connector is fitted on the circuit board. In a modification, it is permissible for the frame member to be incorporated from the start as one member of the insulating housing.

Next, the edge portion of the circuit board is pressed into the insertion recess of the frame member. When this is done, the projection of the frame member mates with the locking recess of the circuit board. As a result, the circuit board is brought to the correct position in the transverse direction and moves in unison with the frame member.

When the circuit board is pressed in further, the accompanying frame member is moved into the insulating housing and stops when the connector assumes a position at which it is correctly and completed fitted on the circuit board. In addition, since the locking portions of the frame member are spaced away from the area of the horizontal portions of the contacts owing to this movement, the contacts come into resilient pressured contact with the circuit portions of the circuit board in a direction at right angles to the surface of these portions.

Finally, the contacts and circuit portions are heated to solder and connect the two together by means of a cream solder applied to the circuit portions in advance.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

A first embodiment of the present invention will now be described with reference to FIG. 1 and FIGS. 2A through 2C.

Figure 1:
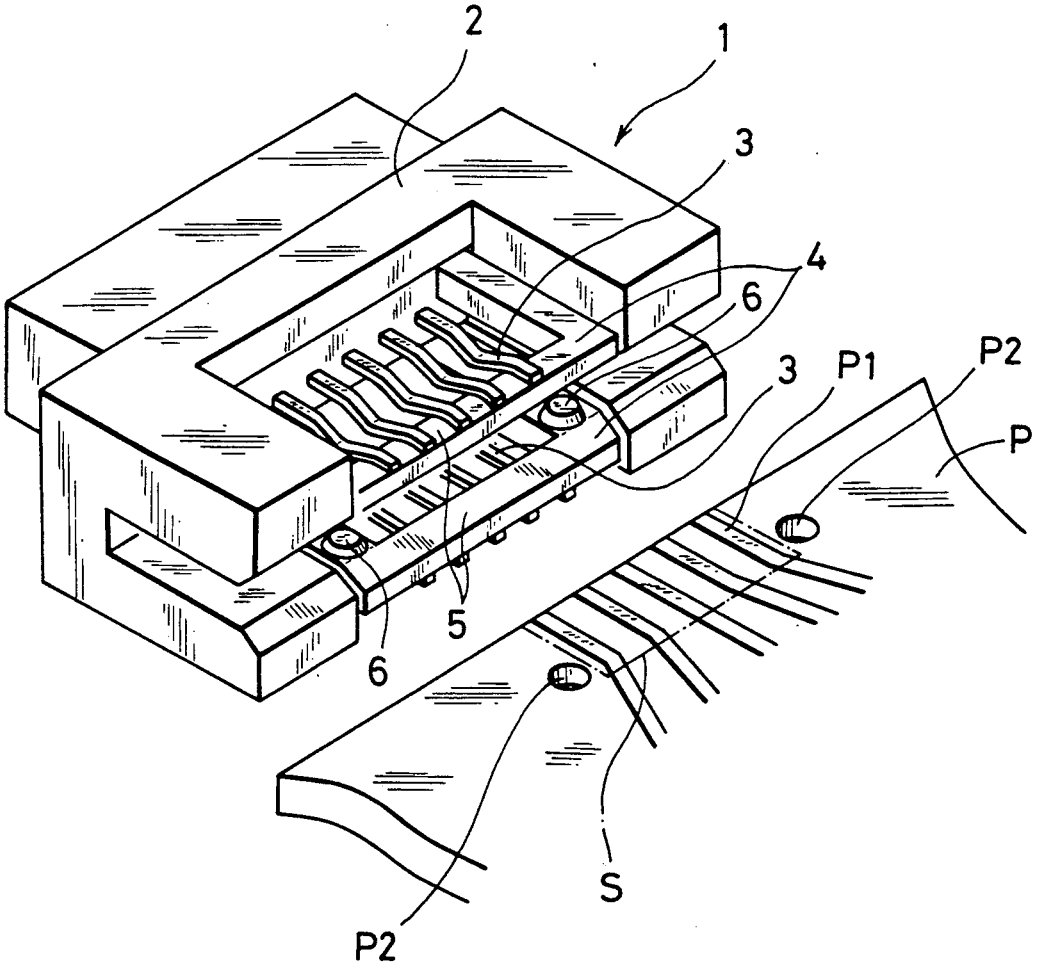
FIG. 1 is a perspective view showing a first embodiment of an electrical connector according to the present invention, as well as a circuit board to which the connector is attached.

As shown in FIG. 1, numeral 1 denotes a first embodiment of an electrical connector to be fitted on a circuit board P. The circuit board P has an edge portion on which circuit portions P1 for connecting purposes are formed, and is provided with locking holes P2, one on each side of the row of circuit portions P1.

The connector 1 includes an insulating housing 2 on which a plurality of contacts 3 arranged in two parallel rows, one above the other, are held in cantilevered fashion. The two parallel rows of contacts 3 are bent at their intermediate portions in such a manner that opposing contacts approach each other, with the spacing between the opposing contacts being smaller than the thickness of the circuit board P.

Figure 2A:
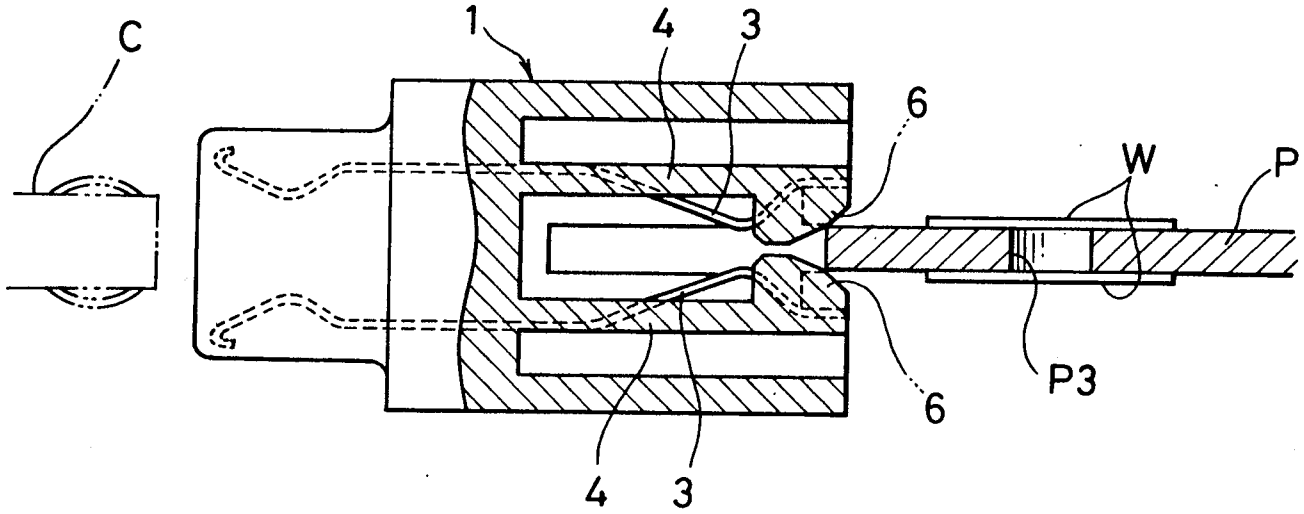
FIGS. 2(A) through 2(C) are sectional views showing a procedure through which the electrical connector and circuit board of FIG. 1 are fitted together.
Figure 2B:
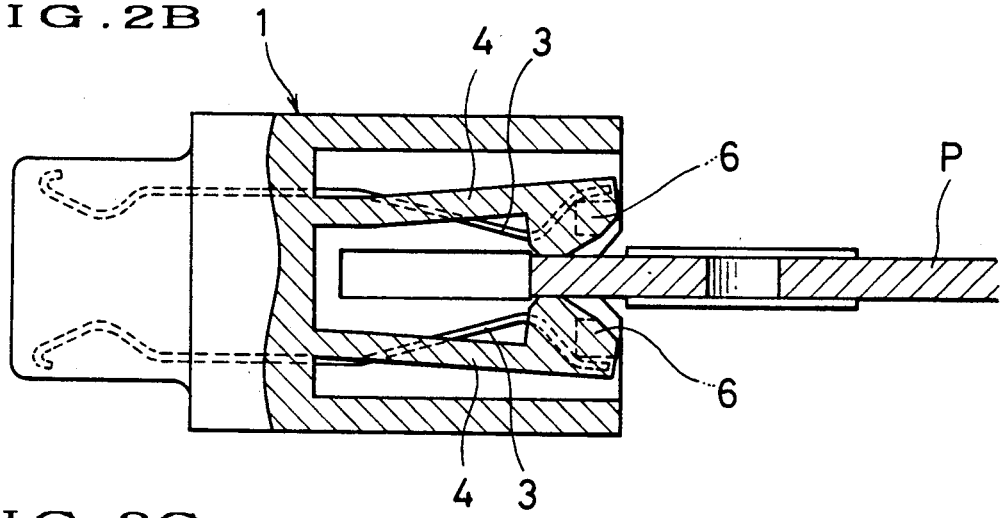

The contacts 3 face a connector-receiving recess (not shown) formed in a rear portion of the insulating housing 2 and are adapted to contact the corresponding contacts of a mating connector C [see FIG. 2(A)]inserted into the above-mentioned connector-receiving recess.

The insulating housing 2 is provided with two resilient arms 4 arranged one above the other in symmetrical fashion. The arms 4 project from both sides of the upper and lower rows of contacts 3 and extend in the same direction as the contacts 3, the distal ends of the arms being connected by connecting portions 5. The upper and lower resilient arms 4 together support the distal ends of the upper and lower contacts 3 from their inner sides.

The opposing inner surfaces of the resilient arms 4 are provided with projections which engage with the locking holes P2 of the circuit board P.

The procedure for fitting the electrical connector of the first embodiment on the circuit board P will now be described.

(1) First, before the connector is attached, a cream solder W is applied over an area S (see FIG. 1) of the circuit portions P1 of circuit board P. This is shown in FIG. 2(A).

(2) Next, the connector 1 is fitted on the circuit board P from the edge portion thereof provided with the circuit portions P1. At this time, the projections 6 provided on the upper and lower resilient arms 4 of the connector come into abutting contact with the edge portion of the circuit board P, as a result of which the upper and lower resilient arms 4 are spread apart owing to elastic deformation [see FIG. 2(B)]. As a result, the bent intermediate portions of the upper and lower contacts 3 are elastically deformed so as to be spaced away from the top and bottom surfaces of the circuit board P.

Figure 2C:
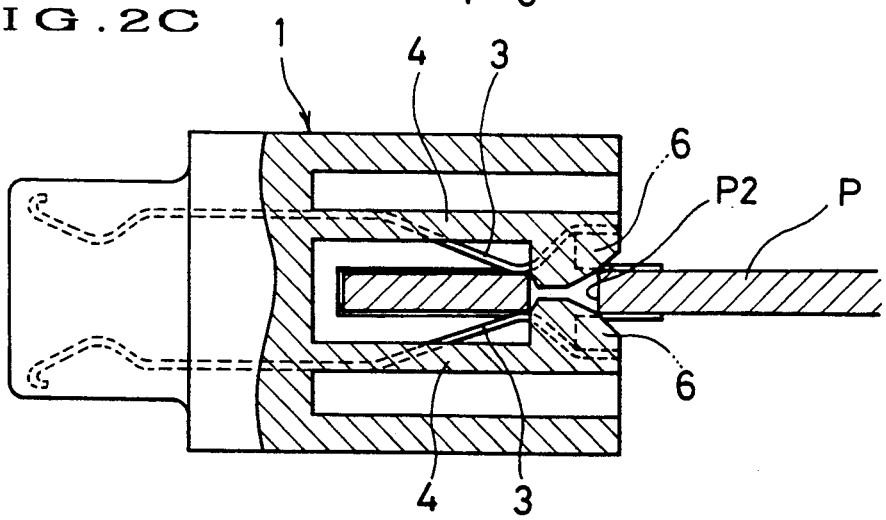

(3) The circuit board P thus receives the connector 1 at a correct position where the contacts 3 are not in contact with the board. At this position, as shown in FIG. 2(C), the projections 6 of the resilient arms 4 engage with the corresponding locking holes P2, whereby the arms 4 are maintained at this position and return simultaneously to their normal state in which they are no longer elastically deformed i.e., no longer deflected away fromthe board. As a result, the contacts 3 come into resilient pressured contact with the circuit portions P1 of circuit board P at right angles to the surface of the circuit portions.

(4) Finally, the cream solder at the portions of contact between the contacts 3 and the circuit portions P1 is heated to solder and connect the contacts to the circuit portions.

In this embodiment of the invention, both the contacts and the resilient arms supporting them are provided above and below the circuit board. However, it is of course permissible to provide the contacts and the resilient arms on only one side of the circuit board.

Further, the resilient arms need not be formed integral with the insulating housing, as illustrated. It is permissible to form the resilient arms separately of the housing and then combine them with the housing.

Furthermore, if the portion of each resilient arm which supports the contacts is formed to have a groove for retaining each contact at a prescribed position, then the contacts can be positioned more accurately in the direction of connector width and the contact positions can be stabilized to be precisely aligned on the circuit portions of the board.

The present invention as illustrated in this embodiment as described above is so adopted that the contacts do not contact the circuit portions of the circuit board until the connector and circuit board assume correct positions when fitted together. When the circuit board and connector are correctly fitted together, contact at such time is achieved at right angles to the surface of the circuit portions. Therefore, when the connector is attached, the cream solder on the circuit portions is not removed but is maintained intact from the beginning in reliable fashion. Furthermore, since the contacts do not slide on the circuit portions, the surface of each circuit portion is not flawed and therefore the reliability of connection is improved.

A second embodiment of the present invention will now be described with reference to FIG. 3 and FIGS. 4(A) through 4(C).

Figure 3:
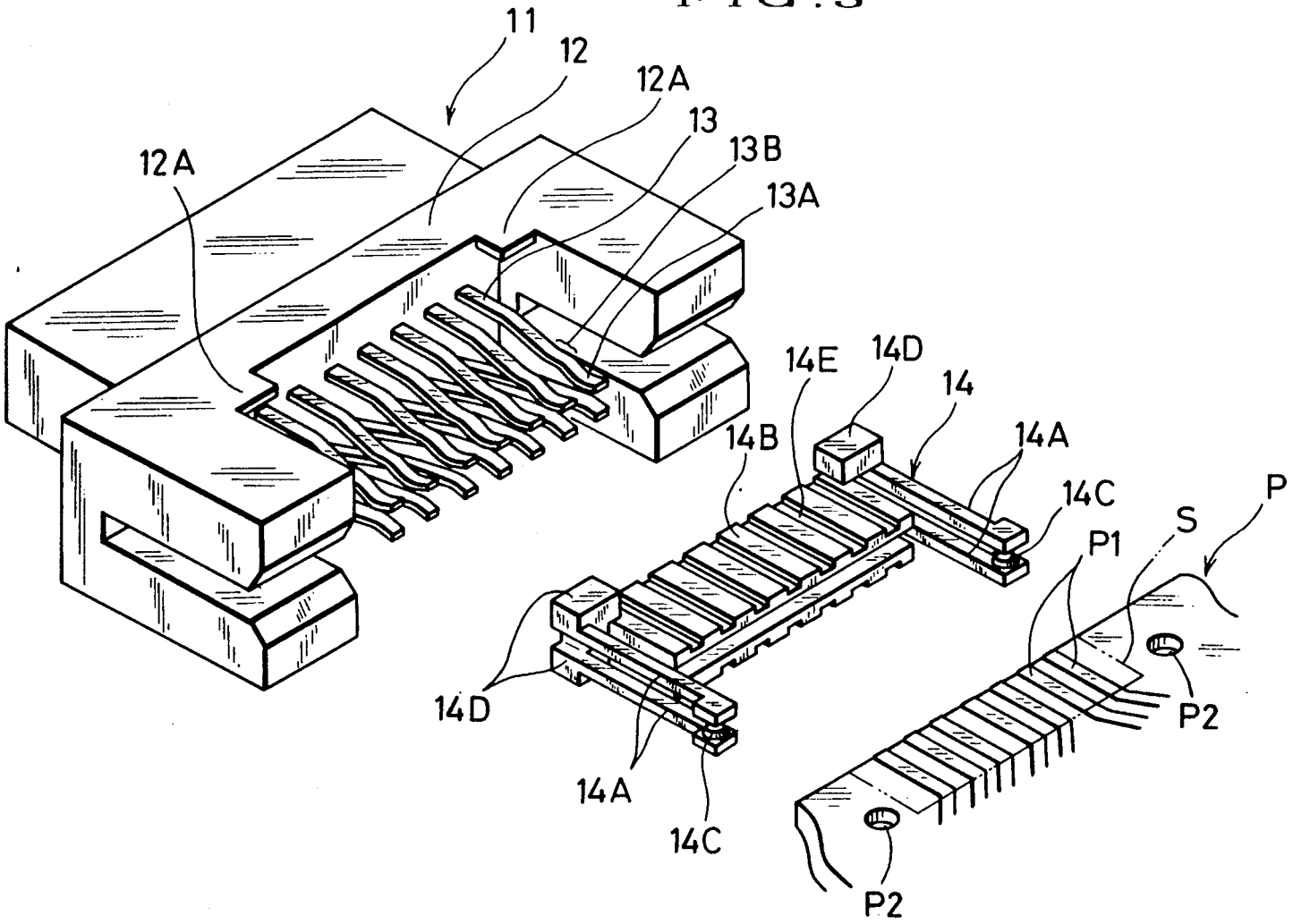
FIG. 3 is a perspective view showing a second embodiment of an electrical connector according to the present invention, as well as a circuit board to which the connector is attached.

A shown in FIG. 3, numeral 11 denotes a second embodiment of an electrical connector to be fitted on the circuit board P. The circuit board P is the same as that used in the first embodiment shown in FIG. 1, and therefore identical portions are designated by like reference characters and need not be described again.

As in the first embodiment, the electrical connector 11 includes an insulating housing 12 on which a plurality of contacts 13 arranged in two parallel rows, one above the other, are held in cantilevered fashion. The two parallel rows of contacts 13 ar bent at their intermediate potions in such a manner that opposing contacts approach each other, with the spacing between most-constricted portions 13*a* of the opposing contacts being somewhat smaller than the thickness of the circuit board P. these structural features are similar to those of the first embodiment. In this embodiment, the intermediate portion of each contact 13 is formed to have a horizontal portion 13*b* at a position offset toward the base end of the contact from the most-constricted portion 13A.

Figure 4A:
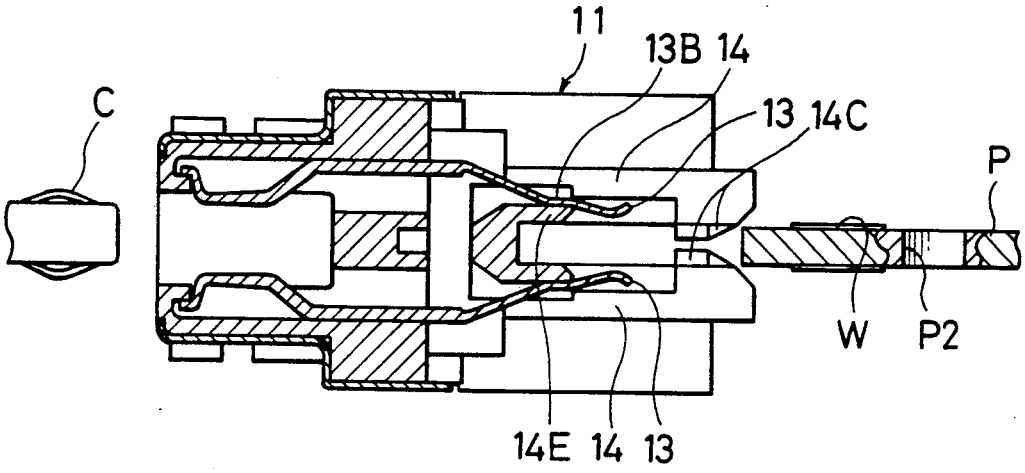
FIGS. 4(A) through 4(C) are sectional views showing a procedure through which the electrical connector and circuit board of FIG. 3 are fitted together.
Figure 4B:
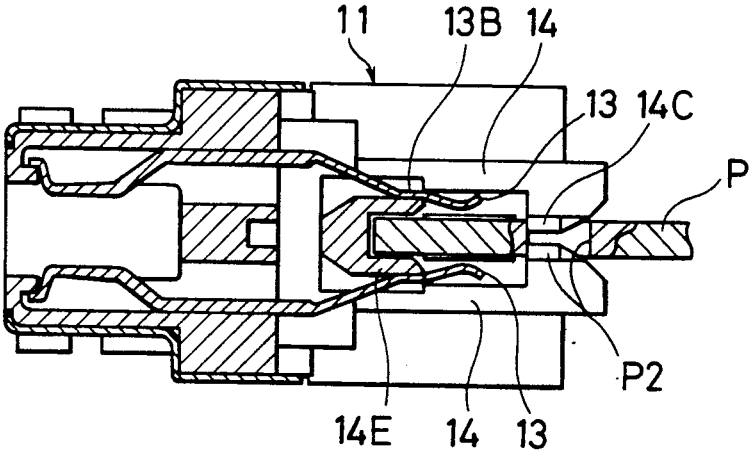
Figure 4C:
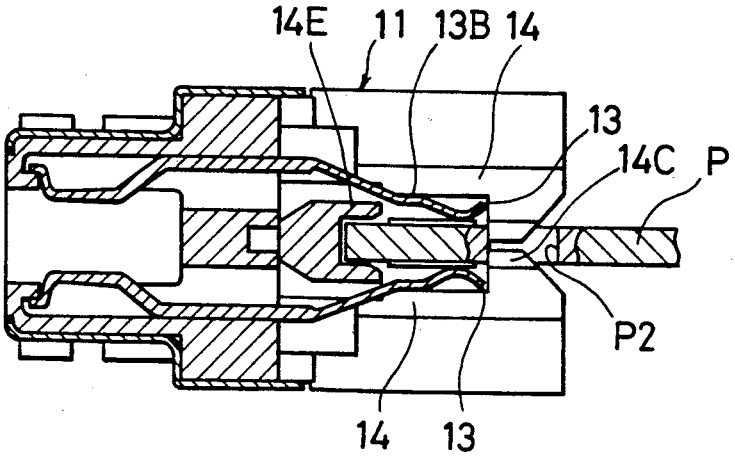
Figure 5:
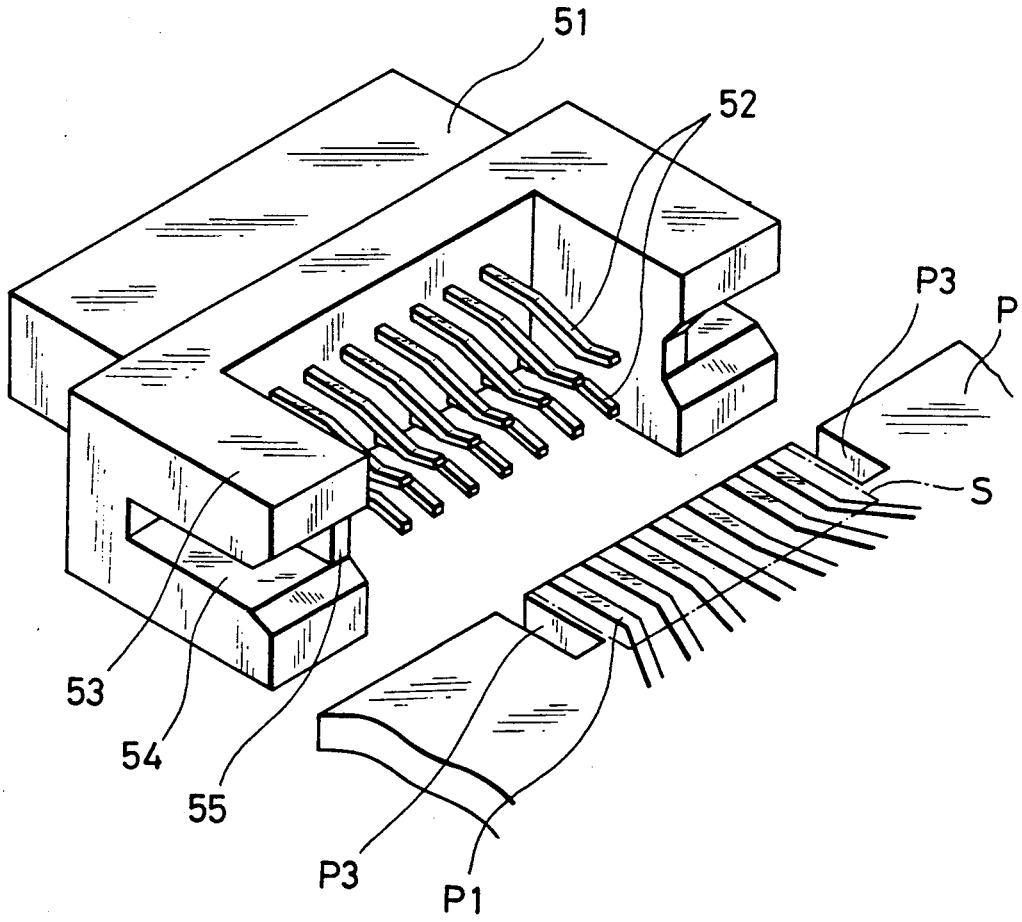
FIG. 5 PRIOR ART
FIG. 5 is a perspective view showing an electrical connector according to the prior art, as well as a circuit board to which the connector is attached.

As in the first embodiment, the contacts 13 face a connector-receiving recess (not shown) formed in a rear portion of the insulating housing 12 and are adapted to contact the corresponding contacts of a mating connector C [see FIG. 4(A)] inserted into the above-mentioned connector-receiving recess.

A frame member 14 is coporated in the simulating housing 12 of this embodiment. The frame member 14 has a pair of upper and lower resilient arms 14A provided on on two opposing sides thereof and extending longitudinally of the contacts 13, and a connecting portion 14*b* connecting the base ends of the pair of resilient arms 14A at the two opposing sides of the frame member 14. The upper and lower resilient arms 14A have distal ends whose mutually opposing surfaces are provided with projections 14C. When the circuit board P is inserted between the upper and lower resilient arms 14A, the projections 14C mate with the locking holes P2 of the circuit board P to effect positioning in the transverse direction (i.e., the direction along the edge of the circuit board) and lock the frame member 14 relative to the circuit board P by joining the two together. The base end of each resilient arm 14A is formed to have block-shaped guided portion 14D adapted to be guided and held by projecting guide portions 12A of the housing 12.

The connecting portion 14B of the frame member 14 has upper and lower surfaces provided with guide grooves 14E serving as locking portions which receive the corresponding horizontal portions 13B of the contacts 13. The guide grooves 14E are set in such a manner that the distance between the bottom surfaces of the upper and lower guide grooves is somewhat larger than the thickness of the circuit board P at the circuit portions P1.

The procedure for fitting the electrical connector of the second embodiment on the circuit board P will now be described.

(1) First, before the connector is attached, a cream solder W is applied over an area S (see FIG. 3) of the circuit portions P1 of circuit board P. This is shown in FIG. 4(A).

(2) Next, the frame member 14 is mounted within the insulating housing 12 and is retained in guidable fashion. In this state the horizontal portions 13B of the contacts 13 slidably engage with the guide grooves 14E serving as the locking portions of the frame member 14. As a result, the contacts 13 elastically deform in a direction which spaces them away from the surface of the circuit on the circuit board P [see FIG. 4(A)].

(3) Thereafter, the circuit board P is pressed into the frame member 14 from the edge thereof provided with the circuit portions P1. When this is done, the projections 14C provided on the upper and lower resilient arms 14A of the frame member 14 come into abutting contact with the circuit board P, as a result of which the upper and lower resilient arms 14A are elastically deformed and spread apart. As the circuit board P is pressed in further, the projections 14C snap into engagement with the locking holes P2 of the circuit board P [see FIG. 4(B)]. Thus, the circuit board P and frame member 14 are joined together. At this time the circuit board P is automatically positioned in the transverse direction by the mating of the projections 14C with the holes P2.

(4) When the circuit board P is pressed in still further, the frame member 14 joined to it moves a predetermined distance into the insulating housing 12 until it abuts against a stopper (not shown). During this movement, the guide grooves 14E of the frame member 14 come into contact with the horizontal portions 13B of the contacts 13 and the contacts 13 remain out of contact with the surface of the circuit portions as before. Then, when the frame member 14 has completely traversed the predetermined distance, the horizontal portions 13B part from the guide grooves 14E serving as the locking portions, and the contacts 13 come into resilient pressured contact with the circuit portions P1 from a direction at right angles thereto [see FIG. 4(C)].

(5) Finally, the cream solder at the portions of contact between the contacts 13 and the circuit portions P1 is heated to solder and connect the contacts to the circuit portions.

In accordance with the second embodiment of the invention, the contacts, the resilient arms of the frame member which support the contacts, and the locking portions are provided above and below the circuit board. However, it is of course permissible to provide these elements on only one side of the circuit board.

In this embodiment, the locking portions of the frame member are formed as guide grooves in the preferred example in order to improve the accuracy of guiding and positioning. However, the frame member may be formed merely to have a planar surface for elastically deforming the horizontal portions of the contacts.

According to the present invention as illustrated in the second embodiment as described above, the arrangement is such that the contacts do not contact the circuit portions of the circuit board until the connector and circuit board assume correct positions when fitted together. When the circuit board and connector are correctly fitted together, contact at such time is achieved at right angles to the surface of the circuit portions. Therefore, when the connector is attached, the cream solder on the circuit portions is not removed but is maintained intact from the beginning. Soldering can be performed even more reliably than in the first embodiment. Furthermore, since the contacts do not slide on the circuit portions, the surface of each circuit portion is not flawed and therefore the reliability of connection is improved.

As many widely different embodiments of the present invention can be made without departing from the spirit and scope thereof, it is to be understood that the invention is not limited to the specific embodiments thereof except as defined in the appended claims.

What is claimed is:

1. In an electrical connector for receiving a circuit board and have contacts for coming into resilient pressured contact with circuit portions of the circuit board, said contacts and said circuit portions adapted to be soldered together by heating cream solder that was applied to said circuit portions of the circuit board prior to said connector receiving said edge portion of the circuit boards, said connector including an insulating housing with said contacts mounted in a said housing in cantilevered state, each contact including an intermediate portion extending in a first direction when it engages said circuit portion of the circuit board, the improvement comprising an insulating frame for receiving said edge of said circuit board, said frame and edge of the circuit board being insertable into said connector housing until said contacts engage said circuit portion, said frame being insertable into said housing to a first position, the edge of the board then being insertable into said frame, said frame with said board being further insertable into said housing to a second portion, said frame further comprising first means for elastically deflecting said contacts in a second direction transverse of the first direction when said frame is inserted into said housing to said first position, said first means allowing said contacts to resiliently return toward and engage said circuit portions when said fame and board are moved from said first to said second position.

2. A connector according to claim 1 wherein said frame and housing comprise third and fourth positioning means respectively, said third and fourth positioning means being engageable together when said frame is inserted into said housing to said predetermined second position.

3. A connector according to claim 1 wherein said frame further comprises a plurality of parallel grooves extending in said first direction for receiving and guiding said contacts when said frame is inserted to said first and second positions.

4. A connector according to claim 1 wherein the frame and circuit board comprise first and second positioning means respectively, said first and second positioning means being engageable together when the edge of said board is inserted into said frame to a predetermined position, whereby id board is accurately positioned and secured to said frame.

5. A connector according to claim 4 wherein said first positioning means comprises a projection and said second positioning means comprises a recess for receiving said projection.

6. A connector according to claim 5 wherein said first positioning means comprises a resilient arm terminating in said projection.

7. An electrical connector for receiving an edge portion of a circuit board, said connector comprising (a) an insulating housing including contacts for resiliently contacting circuit portions provided on the edge portion of the circuit board to enable the contacts to be soldered to said circuit portions; said contacts mounted in said housing in a cantilevered state, each contact having an intermediate portion extending in a first direction where the connector receives the circuit board; and (b) an insulating frame member, said insulating housing comprising means for guiding and retaining said insulating frame member, said frame member being movable relative to said insulating housing in said first direction;

said frame member further comprising an insertion portion for receiving the edge portion of said circuit board therein and lacking portions for engaging said intermediate portions of said contacts in a first position thereof and elastically deforming said contacts n a second direction which spaces said contacts away from the surface of the circuit portions of said circuit board when said frame member is received by said insulating housing; said frame member further comprising projections positioned to mate with locking recesses formed in the edge portion of said circuit board when the edge portion of said circuit board is inserted into said insertion portion;

said frame member with said edge portion received therein being movable in said first direction into said insulating housing to a second position wherein the edge of said circuit board is fully received in said connector, as a result of which said first portions of said contacts resiliently contact the circuit portions of said circuit board when said frame member and circuit board are fully inserted into the insulating housing.

* * * * *

UNITED STATES PATENT AND TRADEMARK OFFICE

CERTIFICATE OF CORRECTION

PATENT NO. : 5,160,275

DATED : November 3, 1992

INVENTOR(S) : Masura Nakamura et al.

It is certified that error appears in the above-indentified patent and that said Letters Patent is hereby corrected as shown below:

Title page item [73]: after "Hirose Electric Co., Ltd., Tokyo Japan", please add --and NEC Corporation, Tokyo, Japan--.

Signed and Sealed this

Eighteenth Day of October, 1994

*Attest:*

Bruce Lehman

BRUCE LEHMAN

*Attesting Officer*

*Commissioner of Patents and Trademarks*